US005154540A

United States Patent [19]

Barley

[11] Patent Number: 5,154,540

[45] Date of Patent: Oct. 13, 1992

[54] GROUND ANCHORAGE

[76] Inventor: Anthony D. Barley, High View, Harlow Pines, Harrogate, HG3 1PZ, United Kingdom

[21] Appl. No.: 661,666

[22] Filed: Feb. 27, 1991

[51] Int. Cl.[5] ..... E02D 5/80

[52] U.S. Cl. ..... 405/259.5; 405/262

[58] Field of Search ..... 405/233, 239, 256, 260, 405/262, 259.5; 52/155

[56] References Cited

U.S. PATENT DOCUMENTS

| | | | |
|---|---|---|---|
| 3,738,071 | 6/1973 | Finsterwalder | 52/155 |
| 4,069,677 | 1/1978 | Yamada et al. | 405/260 |
| 4,386,876 | 6/1983 | Dupeuble | 405/260 |
| 4,449,855 | 5/1984 | Langwadt | 405/260 |
| 4,715,745 | 12/1987 | Reichert et al. | 405/262 |

FOREIGN PATENT DOCUMENTS

| | | | |
|---|---|---|---|
| 1634273 | 8/1970 | Fed. Rep. of Germany | 405/262 |
| 2122094 | 8/1972 | France . | |
| 1549190 | 7/1979 | United Kingdom . | |

*Primary Examiner*—David H. Corbin
*Attorney, Agent, or Firm*—MacMillan, Sobanski & Todd

[57] ABSTRACT

The invention provides ground anchorage means comprising a bore (10) containing a multiple of ground anchorages (11–14) each of which includes a tendon (**11*a*–14*a*) having one end anchored in a capsule (15–18). The capsules (15–18**) are arranged in spaced relation along the bore. The tendons are separately anchored to a common anchor head.

8 Claims, 3 Drawing Sheets

GROUND ANCHORAGE

This invention relates to ground anchorages.

A description of the use and construction of ground anchorages is to be found in the Draft for Development DD81: 1982 published by the British Standards Institution. This Draft also contains suggested terminology.

A typical ground anchorage comprises a bore in the ground which is filled with grout (the bore grout). Received in the bore is a tendon which at its end remote from the open end of the bore is bonded in a capsule comprising a corrugated duct filled with resin or cement grout. The capsule is bonded in the bore grout and the tendon has a free length which has substantially no adhesion to the bore grout and is greased and sheathed. The sheath enters into the capsule so that the tendon bond length in the capsule is somewhat less than the capsule length. At its free end the tendon is received in an anchor head, is stressed against the anchor head and is locked off against it.

The above description relates to a ground anchorage comprising a single tendon. Ground anchorages are also known in which there is a number of tendons which are bonded in a single capsule of elongate form. The ends of the tendons may be arranged in staggered relation within the capsule to spread the load along the capsule.

While this arrangement may transmit a greater tensile load than a ground anchorage comprising only a single tendon, there are limitations in its use since the tendons have to be greased, sheathed and bonded into the capsule under factory conditions and the anchorage then transported to the site where it has to be inserted and anchored in the bore. The length of the capsule which can be used in this construction is limited by the need to be able to transport the capsule from the factory where it is manufactured to the site where it is to be installed.

It is an object of the present invention to provide ground anchorage means which has advantages over the prior constructions.

According to one aspect of the invention, therefore, we provide ground anchorage means comprising a bore in the ground and filled with grout (the bore grout) and a multiple of ground anchorages received in the bore and extending therefrom, each anchorage comprising a tendon having a bond length which is bonded in a capsule containing grout separate from the bore grout and a free length arranged so that there is little or no adhesion between the free length and the bore grout; and wherein each anchorage has a capsule separate from the capsules of the other anchorages, the capsules of the respective anchorages being arranged in staggered spaced relationship along the bore and anchored in the bore grout.

This ground anchorage means has several advantages over the prior art described above.

Firstly, since there is a plurality of separate ground anchorages in the bore, if one of these ground anchorages should fail this will only reduce the load capacity by a certain amount and the other anchorages will still carry their full loads. Where multiple tendons are anchored in a common capsule then de-bonding of any one tendon will cause the anchorage to be rejected.

Secondly, the ground anchorages are convenient to transport to site since the capsule of each anchorage is comparatively short, e.g. one to three metres, and thus the capsule and the free length of the tendon can easily be transported to site.

To increase the bond of a tendon within the capsule, each tendon is preferably deformed within its capsule. If a tendon is wire strand then outer wires may be unlaid, and a ferrule put on the king wire and then relaid.

The capsule will normally include one or more corrugated ducts containing grout.

The ground anchorage means will include an anchor head at the open end of the bore and each tendon will be received in a separate hole in the head and separately stressed and locked off in relation thereto.

The invention also provides a method of making ground anchorage means comprising forming a bore in the ground, placing a plurality of ground anchorages in the bore, each anchorage comprising a tendon having a bond length bonded in a capsule containing grout and a free length arranged to have little or no adhesion to surrounding grout in the bore, each anchorage having a capsule separate from the capsules of the other anchorages, arranging the capsules of the respective anchorages in staggered spaced relation along the bore and then filling the bore with grout to anchor said capsules therein, fitting an anchor head onto the tendons, stressing each tendon separately, and locking the stressed tendons individually with respect to the anchor head.

The invention will now be described in detail by way of example with reference to the accompanying diagrammatic drawings in which.

Figure 1:
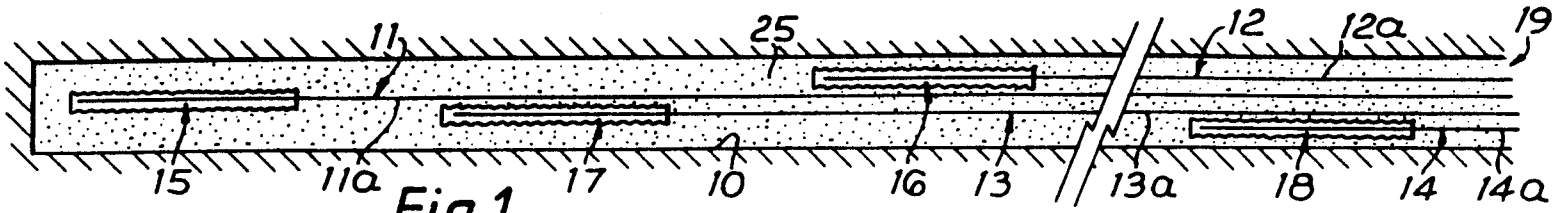
FIG. 1 is a section through ground anchorage means embodying the invention.

Referring now to FIG. 1, the ground anchorage means comprises a bore 10 formed in the ground either vertically or at some other desired angle.

Within the bore are four separate ground anchorages 11, 12, 13 and 14 each of which includes a tendon 11*a*, 12*a*, 13*a* and 14*a* and conveniently consists of seven-wire strand with a king wire and six wires wound about it.

Each anchorage comprises a capsule indicated respectively at 15 to 18 and these are arranged in the bore in staggered spaced relation along the bore. Thus the capsule 15 is nearest to the bottom of the bore, the capsule 17 is spaced away from the capsule 15 towards the free end 19 of the bore, the capsule 16 is spaced from the capsule 17 and the capsule 18 is spaced from the capsule 16.

Figure 2:
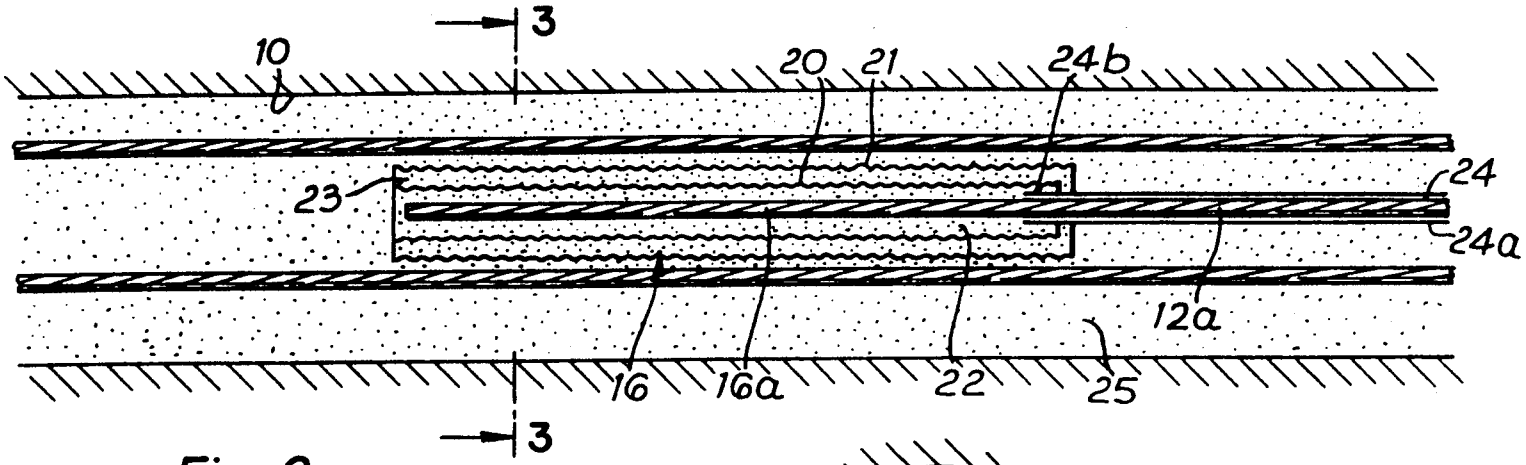
FIG. 2 is a detail longitudinal section of the means of FIG. 1 showing one capsule construction.

Each capsule comprises a duct containing a mass of grout in which the bond length of the tendon is anchored. Thus as shown in FIG. 2 the bond length 16*a* of the tendon 12*a* for example is surrounded by a first corrugated plastic duct 20 which in turn is surrounded by a further corrugated plastic duct 21 spaced from the duct 20. The space within the plastic duct 20 which is indicated at 22 is filled with a cement or resin-based grout and the space 23 between the ducts 20 and 21 is also filled with a similar grout. The bond length of the tendon may be deformed in a manner not shown by unwrapping the strand, putting a ferrule on the king wire and then reforming the strand.

Figure 3:
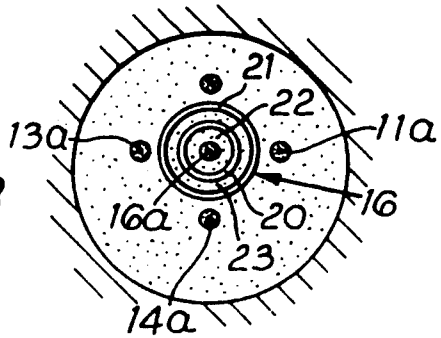
FIG. 3 is a section on a line 3—3 of FIG. 2.

It will be seen from FIG. 3 that the other tendons in the bore 10 pass alongside the capsule 16.

The free length of the tendon 12*a* is greased and is covered with a plastic sheath 24 and an outer plastic sheath 24*a* which extend at 24*b* into the grout 22 in the capsule 16 thus completely protecting the tendon. Similarly the free length of each of the other tendons is greased and sheathed.

The plastic sheaths and the grease prevents or reduces adhesion between the free lengths of the tendons and a mass of grout 25 which fills the bore 10. This bore grout anchors the capsules 16–18 of the anchorages 11–14 in the bore 10, good adhesion being obtained between the bore grout and the capsules due to the corrugated shape of the plastic ducts defining the capsules.

Thus since the capsules 15 to 18 are staggered along the length of the bore 10 and since there is substantially no adhesion between the free lengths of the tendons and the bore grout 25, the load transmitted between each anchorage and the ground is exerted over a fixed length through the bore grout 25 to the ground. Since the capsules and their associated fixed lengths are staggered along the length of the bore 16, the loads of the separate anchorages are spread along the length of the bore so that there is less tendency for the ground to be overloaded by this multiple anchorage. Each anchorage will be separately stressed with respect to an anchor head (not shown) and locked off relative to the head.

Each anchorage is manufactured under factory conditions and the bond length of the anchorage tendon is encapsulated in its own capsule of grout within the plastic duct or ducts as described above. The free length of each tendon is greased and sheathed. The anchorages may then easily be transported to site since the capsules are approximately one to three metres in length and the free lengths of the tendons can be suitably coiled for transport purposes. The anchorages can be manufactured in appropriate lengths depending on their ultimate positions in the bore 10.

Figure 5:
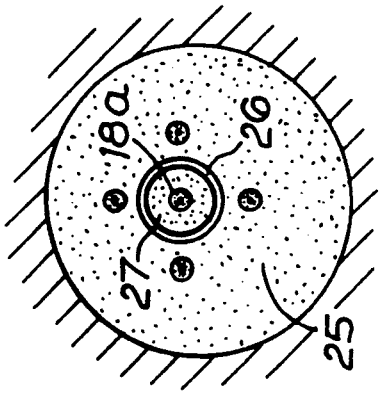
FIG. 5 is a section on the line 5—5 of FIG. 4.

On arrival at site, the anchorages are then inserted into the bore so that the capsules are staggered along the length of the bore with the free lengths of the other anchorage tendons passing alongside the capsules as clearly shown in FIGS. 3 and 5. The bore 10 is then filled with grout. When this grout sets it anchors the capsules in the bore. The load which can be transmitted by the anchorage means is spread along the length of the bore due to the staggered spaced relation of the capsules of the anchorages.

Figure 6:
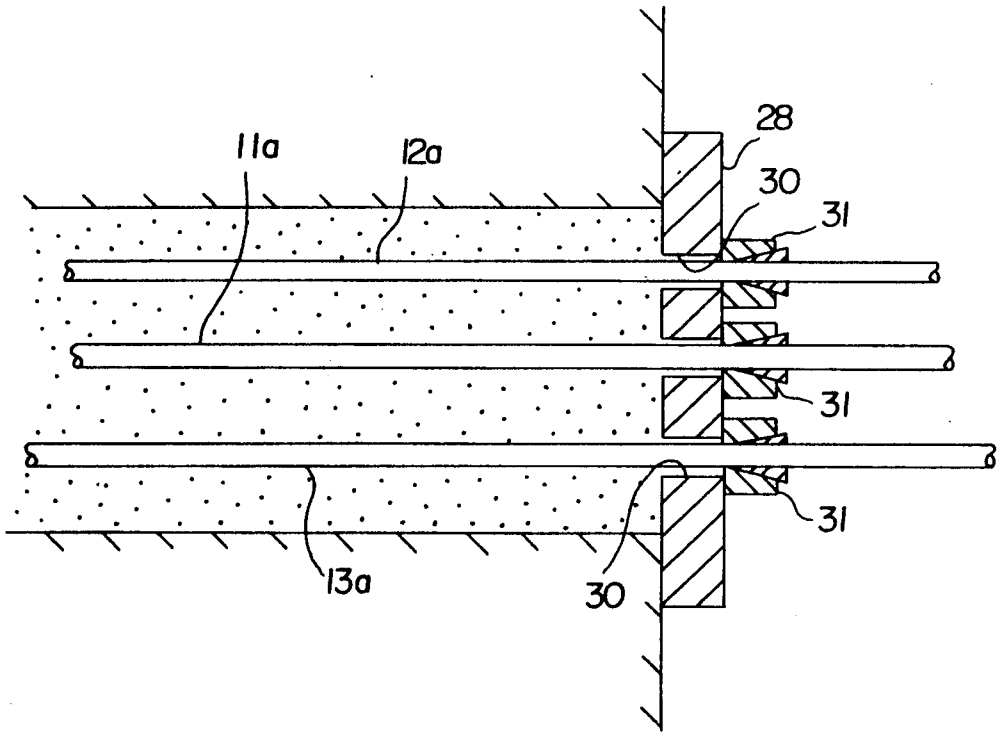
FIG. 6 is a fragmentary cross sectional view showing an exemplary anchor head.

The anchor head 28 (FIG. 6) is arranged at the open end 29 of the bore and has a number of holes 30 equal to the number of anchorages, each anchorage tendon (11*a*, 12*a* and 13*a* illustrated) passing through a separate hole 30 in the anchor head. The tendons are then individually stressed by means of a jack (not shown) and each tendon is individually anchored with respect to the anchor head 29 by the use of a collet 31. Anchor heads and collets for tensioning tendons are known in the prior art as shown in U.S. Pat. No. 4,449,855, for example.

Figure 4:
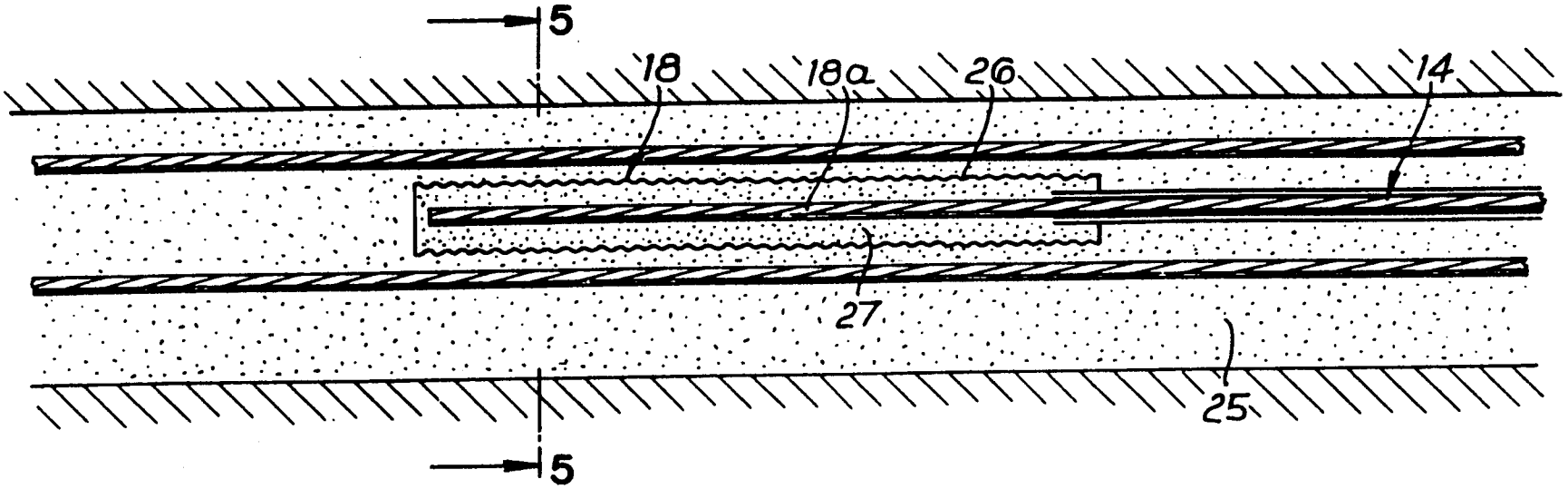
FIG. 4 is a detail longitudinal section of the means of FIG. 1 showing another capsule construction.

FIG. 4 shows a slightly different capsule. In this case the fixed length 18*a* is shown and this is surrounded by a single corrugated plastic sheath 26 which is filled with resin or cement based grout 27. The free length of each tendon is greased and provided with a single plastic sheath.

It will be seen that the invention provides a anchorage means in which the load on the ground is staggered along the length of the bore hole and therefore there is less liklihood of the ground being overloaded or the anchor failing. Moreover the ground anchorage components are easy to manufacture, transport and instal. In addition should one of the ground anchorages fail the loads carried by the remainder will be unaffected.

I claim:

1. A ground anchorage means comprising a bore in the ground filled with bore grout, and a plurality of ground anchorages received in the bore and extending therefrom, each of said anchorages comprising a tendon having a bond length which is bonded in a capsule containing grout separate from said bore grout and a free length extending through said bore grout, means preventing any substantial adhesion between said free length of each tendon and said bore grout, wherein each of said anchorages has a capsule separate from the capsules of the other anchorages, and wherein the capsules of said respective anchorages are arranged in staggered spaced relationship along the bore and anchored in said bore grout.

2. Ground anchorage means according to claim 1, wherein each capsule comprises at least one corrugated duct containing grout.

3. Ground anchorage means according to claim 1, and wherein the bond length of each tendon is formed within its capsule.

4. Ground anchorage means according to claim 3, wherein each capsule comprises at least one corrugated duct containing grout.

5. Ground anchorage means according to claim 4, wherein the bore has an open end, and including an anchor head at the open bore end, said anchor head having a separate hole receiving each tendon, and wherein each tendon is separately stressed and attached to said anchor head.

6. Ground anchorage means according to claim 1, wherein the bore has an open end, and including an anchor head at the open bore end, said anchor head having a separate hole receiving each tendon, and wherein each tendon is separately stressed and attached to said anchor head.

7. A method of making a ground anchorage means comprising the steps of: forming a bore in the ground; placing a plurality of ground anchorages in the bore, each of said ground anchorages comprising a tendon having a bond length bonded in a capsule containing grout and a free length which has no substantial adhesion to grout, each anchorage having a capsule separate from the capsules of the other anchorages; arranging the capsules of the respective anchorages in staggered spaced relation along the bore; filling the bore with grout to anchor said capsules therein; fitting an anchor head onto the tenons; stressing each tendon separately; and locking the stressed tendons individually with respect to the anchor head.

8. A method according to claim 7, wherein each tendon is passed through a separate hole in the anchor head.

* * * * *